US010125986B2

(12) United States Patent
Guerra

(10) Patent No.: US 10,125,986 B2
(45) Date of Patent: Nov. 13, 2018

(54) FLARE PILOT WITH WATER ACCUMULATION EVACUATION

(71) Applicant: Stackmatch Flare Ignition, Inc., Plano, TX (US)

(72) Inventor: Romeo E. Guerra, Plano, TX (US)

(73) Assignee: Stackmatch Flare Ignition, Inc., Plano, TX (US)

( * ) Notice: Subject to any disclaimer, the term of this patent is extended or adjusted under 35 U.S.C. 154(b) by 397 days.

(21) Appl. No.: 14/936,185

(22) Filed: Nov. 9, 2015

(65) Prior Publication Data

US 2017/0130959 A1 May 11, 2017

(51) Int. Cl.

| | |
|---|---|
| ***F23D 14/00*** | (2006.01) |
| ***F23Q 9/00*** | (2006.01) |
| ***F23G 7/08*** | (2006.01) |
| ***F23D 99/00*** | (2010.01) |
| ***F23D 14/24*** | (2006.01) |

(52) U.S. Cl.

CPC ..... *F23G 7/08* (2013.01); *F23D 14/24* (2013.01); *F23D 91/00* (2015.07); *F23Q 9/00* (2013.01)

(58) Field of Classification Search

USPC ..... 431/5, 19, 202, 264, 278

See application file for complete search history.

(56) References Cited

U.S. PATENT DOCUMENTS 3,868,779 A * 3/1975 Wilt, Jr. ..... F23G 5/50 34/212
4,087,923 A * 5/1978 Wilt, Jr. ..... F23G 5/50 110/214
4,406,615 A 9/1983 Guerra
4,595,354 A 6/1986 Guerra
4,678,430 A * 7/1987 Guerra ..... F23Q 3/008 431/154
4,746,285 A * 5/1988 Guerra ..... F23Q 3/008 431/158
4,850,856 A * 7/1989 Guerra ..... F23N 5/126 431/154
4,906,175 A * 3/1990 Guerra ..... F23N 5/126 431/202
4,976,608 A * 12/1990 Hyde ..... F23G 7/085 431/202
5,158,442 A 10/1992 Guerra
5,873,712 A * 2/1999 Guerra ..... F23G 7/085 431/202
5,968,320 A * 10/1999 Sprague ..... C10B 27/00 122/5

(Continued)

*Primary Examiner* — Steven B McAllister
*Assistant Examiner* — Desmond C Peyton
(74) *Attorney, Agent, or Firm* — James Bradley; Bracewell LLP

(57) ABSTRACT

A flare pilot assembly has inner and outer tubes, defining inner and outer passages. A manifold delivers air and fuel to the outer passage. A bleed off passage directs a portion of the fuel and air entering the manifold to the exterior of the manifold. A diversion port in the inner tube diverts into the inner passage a portion of the air and fuel flowing through the outer passage. An electrical sparking device ignites air and fuel flowing through the inner passage. An evacuating tube extends from the manifold through the inner passage to the distal portion of the inner tube. The evacuating tube conveys moisture that may accumulate at the distal portion of the inner passage through the bleed off passage to the exterior.

20 Claims, 3 Drawing Sheets

(56) References Cited

U.S. PATENT DOCUMENTS

Figure 1:
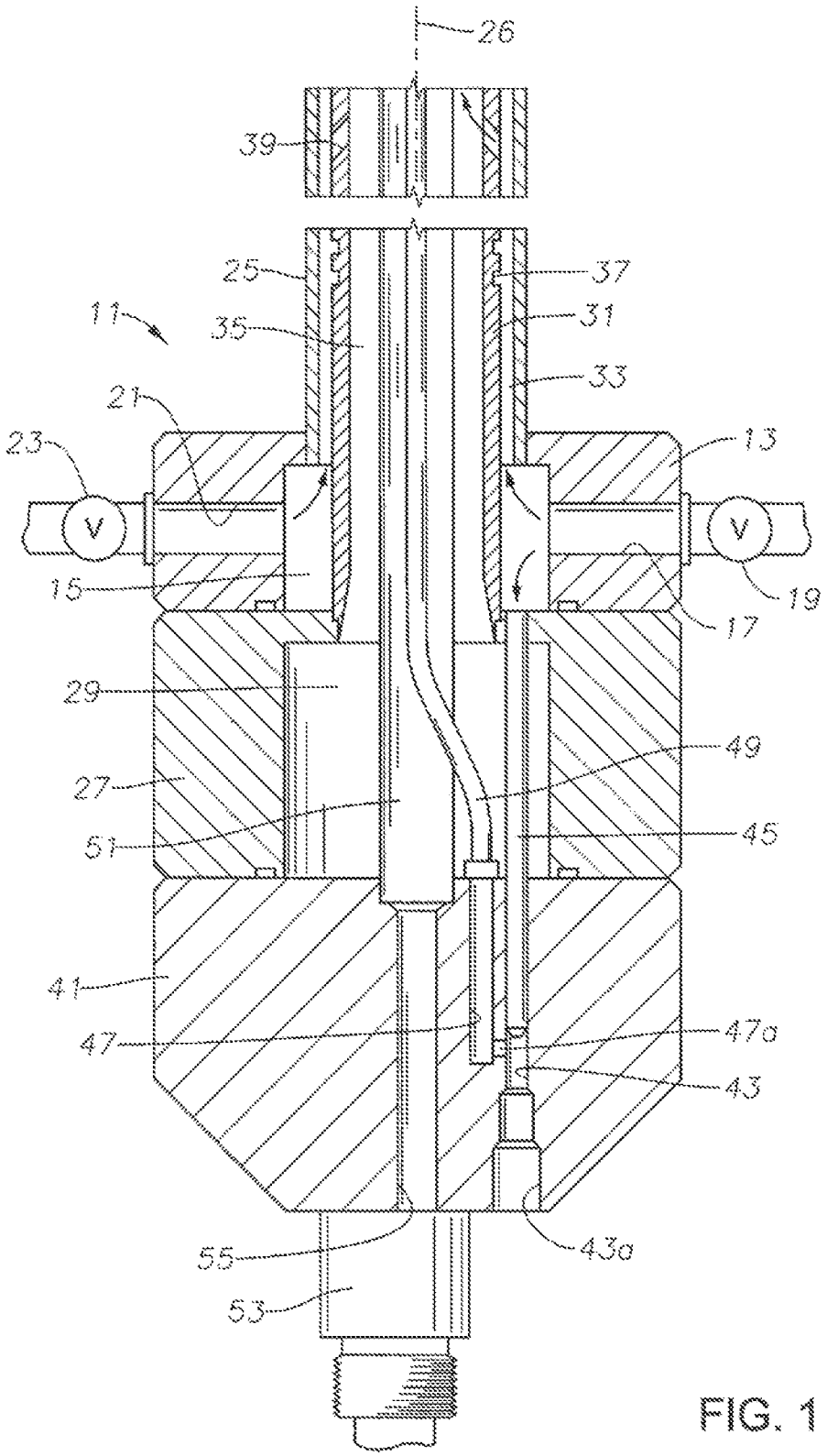

| | | | | |
|---|---|---|---|---|
| 6,485,292 | B1 * | 11/2002 | Rhodes | F23G 7/085 431/202 |
| 6,568,933 | B1 | 5/2003 | Guerra | |
| 8,629,313 | B2 * | 1/2014 | Hong | F23G 5/50 431/5 |
| 8,967,995 | B1 * | 3/2015 | Griffin | F23G 7/085 431/202 |

* cited by examiner

FLARE PILOT WITH WATER ACCUMULATION EVACUATION

FIELD OF THE DISCLOSURE

This disclosure relates in general to pilot unite for igniting waste gas emitted from a stack, and in particular to features that enable evacuation of water that may accumulate in the pilot unit due to weather or steam being vented through the stack.

BACKGROUND

Flare pilot devices are mounted to stacks to ignite waste gasses being discharged through the stack. A flare pilot typically has a nozzle into which compressed air and a gaseous fuel flow. An electrical sparking device creates a spark that ignites the air and fuel mixture, creating a flame at the nozzle. The flame ignites the waste gasses.

Moisture tends to accumulate within the flare pilot, both during operation and while off. Often, the flare pilot is mounted vertically with the nozzle at the upper end. The moisture may occur due to rain and/or snow. The moisture may also occur in response to water vapor separating from the compressed air being injected. Further, the stack may be creating steam, which causes moisture to condense. If the moisture is allowed to accumulate in the pilot, damage can occur to the components.

SUMMARY

A flare pilot assembly has a primary rube having a proximal end, a distal end, and an inner passage extending between the proximal and distal ends. A manifold on the proximal end of the primary tube has an air passage and a gaseous fuel passage leading to a manifold chamber for supplying air and fuel to the manifold chamber. The primary tube has a fuel and air flow port for receiving in the inner passage air and fuel supplied from the manifold chamber. An electrical sparking device mounted in the primary tube adjacent the distal end ignites air and fuel flowing through the inner passage. A bleed off passage in the manifold leads from the manifold chamber and has a bleed off passage outlet on an exterior of the manifold for diverting a portion of the air and fuel entering the manifold chamber through the bleed off passage outlet. An evacuating tube extends from the manifold through the inner passage. The evacuating tube has an open proximal end in fluid communication with the bleed off passage and an open distal end adjacent the sparking device. The air and fuel flowing out the bleed off passage outlet create a suction at the open distal end of the evacuating tube for conveying to the exterior moisture that may accumulate in a distal portion of the inner passage.

The sparking device is mounted within a tubular member located in the inner passage. A sparking device annulus is located between the sparking device and the tubular member. The open distal end of the evacuating tube extends through a wall of the inner passage into the sparking device annulus. The tubular member may be mounted to a mandrel that extends from the manifold through the inner passage. A swirling device on the distal end of the mandrel has inclined ports to cause swirling of fuel and air flowing through the inner passage. The swirling device has a mandrel opening in registry with the cavity.

The primary tube extends through the manifold chamber, isolating a proximal end of the inner passage from the manifold chamber.

BRIEF DESCRIPTIONS OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

FIG. 1 comprises a sectional view of lower portion of a flare pilot in accordance with this disclosure.

Figure 2:
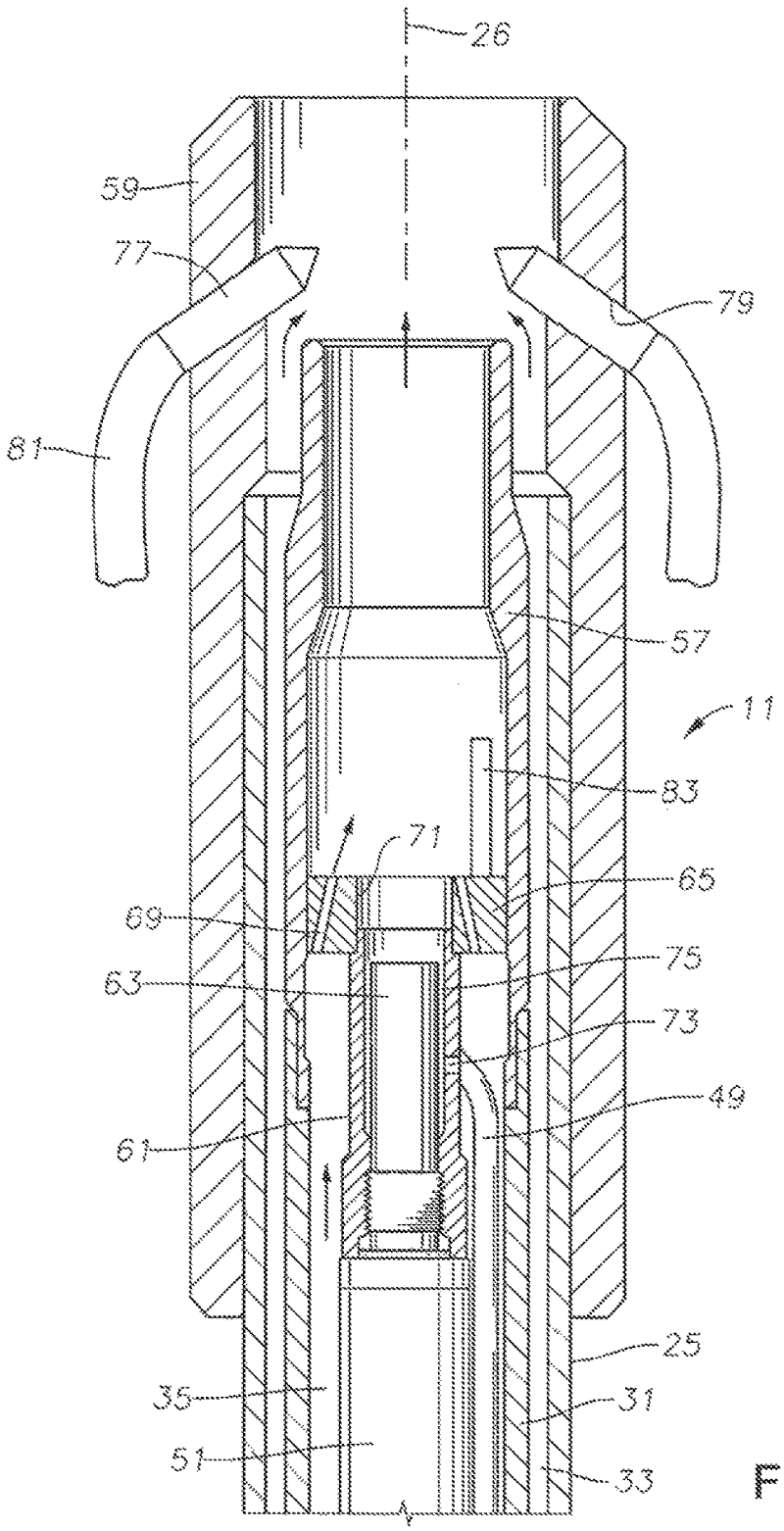

FIG. 2 is a sectional view of the upper portion of the flare pilot of FIG. 1.

Figure 3A:
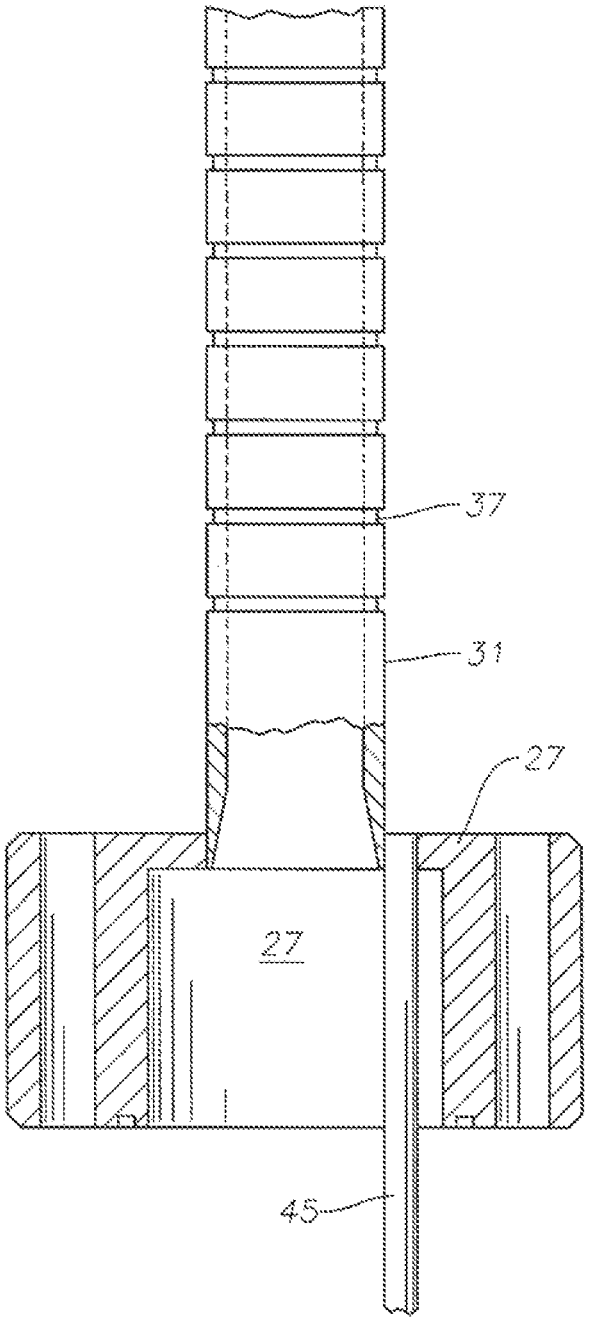
Figure 3B:
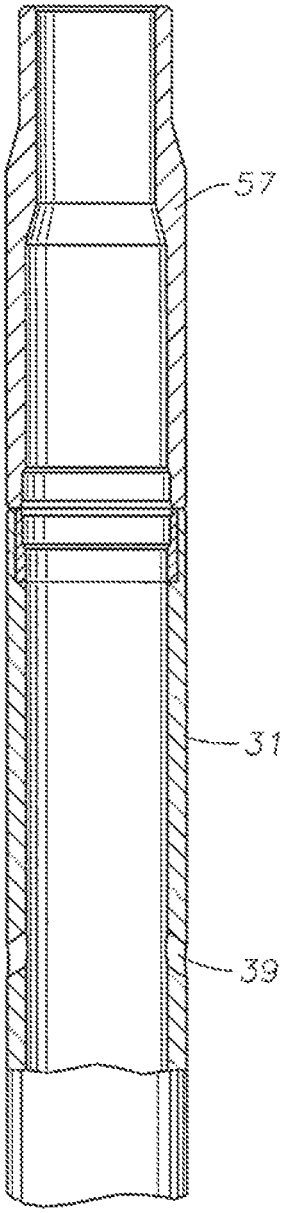

FIGS. 3 A and 3B are a partial sectional view of the inner tube and middle plate if the pilot of FIG. 1, shown removed from the pilot.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, flare pilot 11 will typically be mounted vertically to a stack for igniting waste gasses flowing upward through the stack. Flare pilot 11 has a manifold on its lower or distal end that includes a distal or upper mounting plate 13. Distal mounting plate 13 has flat distal and proximal sides. A manifold chamber 15 extends from the distal to the lower side of distal mounting plate 13. A fuel port 17 leads through distal mounting plate 13 from manifold chamber 15 to a gaseous fuel source having a fuel valve 19. The gaseous fuel source could be natural gas, propane, or other fuels. An air flow port 21 leads through distal mounting plate 13 from manifold chamber 15 to a supply compressed air having an air supply valve 23. Controlling valves 19, 23 causes a flow of fuel and air into manifold chamber 15 at a pressure that may be about 30 psi above atmospheric, for example, but could differ. The ratio of air flow to fuel flow is conventional and depends on the type of fuel gas used, such as about 10 to 1 for natural gas.

An outer tube 25 has a lower or proximal end secured to the distal side of distal manifold plate 13. The open proximal end of outer tube 25 registers with an opening leading into manifold chamber 15. Outer tube 25 is concentric about a longitudinal axis 26.

In this example, a middle manifold plate 27 has a distal side that abuts and seals to the proximal side of distal manifold plate 13. Middle manifold plate 27 has a central bore 29 extending from the distal to the proximal side of middle manifold plate 27. A primary or inner tube 31 has a lower or proximal end that secures to the distal side of middle manifold plate 27 in registry with central bore 29. Inner tube 31 extends concentrically into outer tube 25, defining an annular outer passage 33 between them. The distal end of outer passage 33 joins manifold chamber 15 for receiving air and fuel flow, as indicated by the arrows. The interior of inner tube 31 defines an inner passage 35 that registers and communicates with central bore 29. A proximal portion of inner tube 31 extends through manifold chamber 15 isolating the proximal end of inner passage 35 from the fuel and air flowing into manifold chamber 15.

Referring also to FIG. 3A, at least one and preferably several grooves or channels 37 are formed in the exterior of inner tube 31. Grooves 37 are annular and may be parallel to each other. Grooves 37 are spaced apart from each other an amount greater than a width of each groove 37. Each groove 37 creates a larger flow area in outer passage 33 that the spaces between each groove 37. The increase and decrease in flow area creates turbulence to enhance mixing of the air and fuel flowing through outer passage 33.

Referring still to FIGS. 1 and 3A one or more diversion ports 39 extend through the side wall of inner tube 31. Diversion ports 39 are located downstream or distally from grooves 37. Diversion ports 39 divert into inner passage 35 a portion of the air and fuel flowing through outer passage 33. The total flow area of diversion ports 39 is considerably less than the flow area of outer passage 33. The smaller flow area results in a much smaller portion of the air and fuel flow entering inner passage 35 than the flow that continues along outer passage 33.

Referring again to FIG. 1, a proximal manifold plate 41 has a distal side that abuts the proximal side of middle manifold plate 27. Bolts (not shown) extend through holes in proximal manifold plate 41, middles manifold plate 27 and into threaded holes in distal manifold plate 13 to secure them together. A bleed off passage 43 extends through distal manifold plate 41 from the distal side to an outlet 43*a* on the proximal side. Bleed off passage 43 joins middle manifold plate central bore 29 and is offset and parallel to axis 26.

A bleed off tube 45 is secured within a hole in middle manifold plate 27. Bleed off tube 45 has an open inlet end within manifold chamber 15. Bleed off tube 45 extends closely into bleed off passage 43 and has an open outlet end that is spaced distally from bleed off passage outlet 43*a*. Bleed off tube 45 causes some of the fuel and air entering manifold chamber 15 to flow through bleed off tube 45 and out bleed off passage outlet 43*a*. The flow area through bleed off tube 45 is much smaller than either the air flow passage 21 or the fuel flow passage 17. The flow area in bleed off tube 45 is also much smaller than the flow area of outer passage 33. The flow rate of air and fuel flowing out bleed off passage 43 is much smaller than the flow rate of air and fuel flowing into outer passage 33. For example, the flow rate of air and fuel flowing out bleed off passage outlet 43*a* may be only about $1/60^{th}$ of the flow rate of air and fuel flowing into outer passage 33.

An evacuating tube passage 47 extends into proximal manifold plate 41 from the distal side of proximal manifold plate 41. A branch portion 47*a* joins evacuating tube passage 47 with bleed off passage 43. Branch portion 47*a* joins bleed off passage 43 approximately at the open outlet end of bleed off tube 45. An evacuating tube 49 has an open proximal end or outlet secured to evacuating tube passage 47. Evacuating tube 49 extends into inner passage 35. The open distal end of evacuating tube 49 will be at the pressure of bleed off passage 43 near outlet 43*a*, which is lower than the pressure in manifold chamber 15. The flow area within evacuating tube 49 may be larger than the flow area of bleed off tube 45.

A shaft or mandrel 51 secures to the distal side of proximal manifold plate 41. Mandrel 51 extends through central bore 29 of middle manifold plate 27 and into inner tube 31. Inner passage 35 is defined by a mandrel annulus surrounding mandrel 51. Wiring extends from an electrical connector 53 secured to proximal manifold plate 41 through one or more wiring passages 55 and into mandrel 51. In this example, the axis of mandrel 51 is offset from outer tube axis 26. Evacuating tube 49 extends alongside mandrel 51 and may be supported by mandrel 51.

Referring to FIG. 2, an inner tube nozzle 57 forms the distal end of inner tube 31. The flow area of the outlet portion of inner tube nozzle 57 may decrease from the inlet portion of inner tube nozzle 57. Inner tube nozzle 57 may be secured to inner tube 31 by a weld. An outer tube nozzle 59 forms the distal end of outer tube 25. Outer tube nozzle 59 may be secured to outer tube 25 by a weld. Outer tube nozzle 59 extends distally farther or above inner tube nozzle 57.

Mandrel 51 has a tabular member 61 secured to its distal end. A sparking device 63 mounts within a cavity of tabular member 61. Wires (not shown) to sparking device 63 extend through mandrel 51 to electrical connector 53 (FIG. 1). A swirling device or member 63 secures to the distal end of manifold tabular member 61. Swirling member 65 comprises a disc with a plurality of air and fuel ports 69 extending through it. Air and fuel ports 69 may be helically inclined relative to axis 26 to create swirling of the air and fuel flowing from inner passage 35 through air and fuel ports 69. The outer periphery of swirling member 65 may fit closely within inner passage 35. A mandrel opening 71 extends from the distal to the proximal sides of swirling member 65. Mandrel opening 71 registers with the cavity inside mandrel tubular member 61. Mandrel tubular member 61 is secured to swirling member 65. Air and fuel ports 69 are spaced around mandrel opening 71. In this example, mandrel opening 71 is offset relative to outer tube axis 26.

Evacuating tube 49 has an open distal end that secures to the side wall mandrel tubular member 61 in registry with an evacuating tube port 73 extending through the side wall of mandrel tubular member 61. Sparking device 63 is smaller in outer diameter than the inner diameter of mandrel tubular member 61, defining a sparking device annulus 75. Evacuating tube port 73 extends into sparking device annulus 75 at a point between the proximal and distal ends of sparking device 63. Because the proximal end of evacuating tube 49 is at a lower pressure than inner passage 35, evacuating tube 49 creates a suction or lower pressure within sparking device annulus 75 than in inner tube nozzle 57.

One or more thermocouples or temperature sensors 77 mount to outer tube nozzle 59. Each temperature sensor 77 extends through a hole 79 in the side wall of outer tube nozzle 59. The tip of each temperature sensor 77 will be radially inward from the inner diameter of outer tube nozzle 59. The tip of each temperature sensor 77 is preferably spaced a short above or distally from the distal end of mixer tube nozzle 57. Temperature sensor holes 79 may be inclined relative to axis 26, as shown, rather than perpendicular to axis 26. A sensor wire tube 81 for each temperature sensor 77 extends alongside outer tube nozzle 59 and outer tube 25 to an instrument (not shown) mounted adjacent manifold plates 13, 27 and 41 (FIG. 1).

A flame sensor electrode 83 mounts to the distal side of swirling member 65. Flame sensor electrode 83 may extend parallel with and offset from axis 26. Flame sensor electrode 83 is closely spaced, but not touching the side wall of inner tube nozzle 57. A flame sensor wire (not shown) extends from flame sensor electrode 83 through inner passage 35 to a control panel (not shown) mounted adjacent manifold plates 13, 27 and 41 (FIG. 1). The control panel supplies a voltage to flame sensor electrode 83 and senses whether or not there is any current flow from flame sensor electrode 83 to inner tube nozzle 57. The presence of a flame around electrode 83 results in an electrical current flow. Without a flame, there would be no electrical current flow through electrode 83.

In operation, referring to FIG. 1, compressed air flows through compressed air valve 23 into manifold chamber 15 and compressed gaseous fuel flows through fuel valve 19 into manifold chamber 15. The air and fuel flow into outer passage 33 and further mix as they flow past mixing grooves 37. A small portion of the air and fuel in outer passage 33 diverts through diversion ports 39 into inner passage 35. A larger portion of the air and fuel continues to flow through outer passage 33. A small portion of the air and fuel flow through bleed off tube 45 out bleed off passage 43*a*. The proximal end of evacuating tube 49 will be placed at the same pressure that exists at bleed off passage 43*a*, which is less than the pressure within manifold chamber 15.

Referring to FIG. 2, the air and fuel in inner passage 35 flow through swirling member ports 69 into inner tube nozzle 57 directly above sparking device 63. Electrical power provided to sparking device 63 causes it to create a spark, igniting the air and fuel flowing out of swirling member ports 69. The flame created by sparking device ignites the air and fuel flowing into outer tube nozzle 59 from outer passage 33. The resulting flame extends distally from outer tube nozzle 59 to ignite waste gases being discharged out the stack.

The fuel and air flowing out of outer passage 33 is relatively cool, reducing damage that might otherwise occur to the weld between outer tube nozzle 59 and outer tube 25. The relatively cool air and fuel also allow temperature sensors 77 to be directly in the flame by keeping outer tube nozzle 59 at a relatively cool temperature.

Weather may cause moisture to accumulate in outer tube nozzle 59 and inner tube nozzle 57. Also, if pilot 11 mounts to a stack generating steam, moisture may occur from the steam. Additionally, the compressed air flowing in may contain water vapor that separates from the air. The moisture may accumulate during operation and/or while not operating. The accumulating water may flow into mandrel tubular member 61, inner passage 35 and outer passage 33. The suction created at evacuating tube port 73 causes the water within sparking device annulus 75 to flow into evacuating tube 49.

Referring to FIG. 1, the lower pressure at bleed off passage outlet 43*a* causes any water that may accumulate in manifold chamber 15 to flow through bleed off tube 45 and out bleed off passage outlet 43. Also, the water flowing through evacuating tube 49 will be drawn through evacuating tube passage branch 47 into bleed off passage 43 and out bleed off passage outlet 43*a*.

While the disclosure has been described in only one of its forms, it should be apparent to those skilled in the art that various changes may be made.

The invention claimed is:

1. A flare pilot assembly, comprising:

a primary tube having a proximal end, a distal end, and an inner passage extending between the proximal and distal ends;

a manifold on the proximal end of the primary tube, the manifold having a pressurized air passage and a gaseous fuel passage leading to a manifold chamber at the proximal end of the primary tube for supplying pressurized air and fuel to the manifold chamber, the primary tube having a fuel and air flow port for receiving in the inner passage air and fuel supplied from the manifold chamber;

an electrical sparking device mounted in the primary tube adjacent the distal end for igniting air and fuel flowing through the inner passage;

a bleed off passage in the manifold having a bleed off passage inlet that receives a portion of the pressurized air flowing into the manifold chamber and having a bleed off passage outlet on an exterior of the manifold;

an evacuating tube extending from the manifold through the inner passage, the evacuating tube having an open proximal end in fluid communication with the bleed off passage outlet and an open distal end adjacent the sparking device; and wherein the portion of the pressurized air flowing out the bleed off passage outlet creates a suction at the open distal end of the evacuating tube for drawing moisture that may accumulate in a distal portion of the inner passage through the evacuating tube and the bleed off passage outlet to the exterior.

2. The assembly according to claim 1, wherein:

the sparking device is mounted within a tubular member located in the inner passage, defining a sparking device annulus between the sparking device and the tubular member; and the open distal end of the evacuating tube extends through a wall of the inner passage into the sparking device annulus.

3. The assembly according to claim 1, wherein:

the primary tube extends through the manifold chamber, isolating a proximal end of the inner passage from the manifold chamber.

4. The assembly according to claim 1, further comprising:

a mandrel having a mandrel axis extending from the manifold through the inner passage, the sparking device being mounted within a cavity in a distal end of the mandrel; and wherein the evacuating tube has an evacuating tube axis offset and parallel to the mandrel axis; and the open distal end of the evacuating tube extends into the cavity.

5. The assembly according to claim 1, further comprising:

a mandrel extending from the manifold through the inner passage, the sparking device being mounted within a cavity in a distal end of the mandrel, the inner passage being located in a mandrel annulus between the mandrel and the inner tube;

a swirling device on the distal end of the mandrel in the mandrel annulus distal from the sparking device, the swirling device having inclined ports to cause swirling of fuel and air flowing through the inner passage downstream from the swirling device; the swirling device having a mandrel opening in registry with the cavity; and wherein the evacuating tube extends alongside the mandrel, and the open distal end of the evacuating tube extends into the cavity.

6. The assembly according to claim 1, wherein:

the inner tube has a proximal portion that extends through the manifold chamber, isolating a proximal end of the inner passage from the manifold chamber.

7. A flare pilot assembly, comprising:

inner and outer tubes concentric with a longitudinal axis, defining an annular outer passage between the inner and outer tubes and an inner passage within the inner tube;

a manifold on a proximal ends of the inner and outer tubes, the manifold having a pressurized air passage and a gaseous fuel passage leading to a manifold chamber at the proximal ends of the inner and outer tubes for mixing air and fuel, the manifold chamber being in fluid communication with the proximal end of the outer passage for delivering mixed air and fuel from the manifold chamber to the outer passage;

a bleed off passage in the manifold having a bleed off passage inlet in the manifold chamber and having a bleed off passage outlet on an exterior of the manifold that opens to the exterior of the manifold, the bleed off passage having a smaller flow area than a flow area of the outer passage, the bleed off passage diverting a portion of the mixed fuel and air in the manifold chamber through the bleed off passage outlet to the exterior of the manifold, creating a lower pressure at the bleed off passage outlet than in the manifold chamber;

a diversion port in the inner tube distal from the manifold chamber for diverting into the inner passage a portion of the air and fuel flowing from the manifold chamber through the outer passage;

an electrical sparking device mounted in a distal portion of the inner tube for igniting air and fuel flowing through the inner passage to create a flame at a distal end of the inner tube to ignite mixed air and fuel flowing out a distal end of the outer passage; and an evacuating tube extending from the manifold through the inner passage to the distal portion of the inner tube, the evacuating tube having an open proximal end in fluid communication with the bleed off passage and an open distal end in fluid communication with the inner passage at the distal portion of the inner tube, the lower pressure at the bleed off passage outlet creating a suction that draws moisture that may accumulate at a distal portion of the inner passage through the bleed off passage and bleed off passage outlet to the exterior of the manifold.

8. The assembly according to claim 7, wherein the bleed off passage inlet is in fluid communication with a proximal end of the outer passage for drawing moisture accumulating in the outer passage through the bleed off passage outlet to the exterior of the manifold.

9. The assembly according to claim 7, further comprising:

a mandrel extending from the manifold through the inner passage to the sparking device; and wherein the evacuating tube extends alongside the mandrel.

10. The assembly according to claim 7, further comprising:

a plurality of grooves extending around an exterior surface of the inner tube, defining a flow area of the outer passage at each of the grooves that differs from a flow area of the outer passage between the grooves.

11. The assembly according to claim 7, wherein:

the diversion port is axially spaced between the manifold and the distal end of the inner tube; and the assembly further comprises:

a plurality of grooves in an exterior surface of the inner tube between the manifold and the diversion port, defining a flow area of the outer passage at each of the grooves that differs from a flow area of the outer passage between the grooves.

12. The assembly according to claim 7, wherein:

the distal end of the outer tube extends distally past the distal end of the inner tube; and the assembly further comprises:

a temperature sensor extending through an aperture in the outer tube into an interior portion of the outer tube that is distally past the distal end of the inner tube.

13. The assembly according to claim 7, further comprising:

a mandrel extending from the manifold through the inner passage, the sparking device being mounted within a cavity in a distal end of the mandrel; and wherein the open distal end of the evacuating tube extends into the cavity.

14. The assembly according to claim 7, further comprising:

a mandrel extending from the manifold through the inner passage, the sparking device being mounted within a cavity in a distal end of the mandrel, the inner passage being located in a mandrel annulus between the mandrel and the inner tube;

a swirling device on the distal end of the mandrel in the mandrel annulus, the swirling device having a mandrel opening in registry with and distal from the cavity, the swirling device having inclined ports outward from the mandrel opening for swirling mixed fuel and air flowing through the inner passage; and wherein the open distal end of the evacuating tube extends into the cavity.

15. A flare pilot assembly, comprising:

inner and outer tubes concentric with a longitudinal axis, defining an annular outer passage between the inner and outer tubes and an inner passage within the inner tube;

a manifold at the proximal ends of the inner and outer tubes, the manifold having pressurized air passage and a fuel passage leading to a manifold chamber at the proximal ends of the inner and outer tubes for mixing air and fuel, the manifold chamber being in fluid communication with the outer passage for delivering the air and fuel to the outer passage, the inner passage having a proximal end isolated from the manifold chamber;

at least one annular groove in an exterior of the inner tube to enhance mixing of the air and fuel flowing from the manifold chamber through the outer passage;

a diversion port in the inner tube between the groove and distal end of the inner tube for diverting into the inner passage a portion of the air and fuel flowing through the outer passage; and an electrical sparking device mounted in a distal portion of the inner tube for igniting the portion of air and fuel flowing through the inner passage to create a flame at the distal end of the inner tube to ignite the air and fuel flowing out a distal end of the outer passage.

16. The assembly according to claim 15, wherein:

a distal end of the outer tube extends distally past the distal end of the inner tube; and the assembly further comprises:

a temperature sensor extending through an aperture in the outer tube into an interior portion of the outer tube that is distally past the distal end of the inner tube.

17. The assembly according to claim 16, further comprising:

a bleed off passage in the manifold having a bleed off passage inlet in the manifold chamber and having a bleed off passage outlet on an exterior of the manifold for diverting a portion of the fuel and air in the manifold chamber to the exterior of the manifold, creating a lower pressure at the bleed off passage outlet than in the manifold chamber;

an evacuating tube extending from the manifold within the inner passage to adjacent the sparking device, the evacuating tube having an open proximal end in fluid communication with the bleed off passage inlet and an open distal end; and wherein the lower pressure of the fuel and air flowing from the manifold chamber out the bleed off passage outlet creates a suction at the open distal end of the evacuating tube for drawing moisture that may accumulate adjacent the sparking device through the evacuating tube and the bleed off passage the exterior.

18. The assembly according to claim 17, wherein the manifold comprises:

a distal manifold plate that contains the manifold chamber, the outer tube being attached to a distal side of the distal manifold plate;

a middle manifold plate having a central bore and having a distal side in abutment with a proximal side of the distal manifold plate, the inner tube being attached to the distal side of the middle manifold plate with the inner passage in fluid communication with the central bore;

a proximal manifold plate that has a distal side in abutment with a proximal side of the middle manifold plate; and wherein, the bleed off passage comprises a bleed off tube having a bleed off tube inlet on the distal side of the middle manifold plate, the bleed off tube extending through the central bore to a bleed off port extending through the proximal manifold plate to the bleed off passage outlet.

19. The assembly according to claim 18, further comprising:

an evacuating tube port extending into the proximal manifold plate from the distal side of the proximal manifold plate and intersecting the bleed off passage; and wherein the evacuating tube is secured to the distal side of the proximal manifold at the evacuating tube port.

20. The assembly according to claim 18, further comprising:

a mandrel extending from the distal side of the proximal manifold plate through the central bore and into the inner passage, the sparking device being mounted within a cavity in a distal end of the mandrel; and wherein the open distal end of the evacuating tube extends into the cavity.

* * * * *